US012256806B2

(12) United States Patent
Avar et al.

(10) Patent No.: US 12,256,806 B2
(45) Date of Patent: Mar. 25, 2025

(54) LACING ARCHITECTURE FOR AUTOMATED FOOTWEAR PLATFORM

(71) Applicant: NIKE, Inc., Beaverton, OR (US)

(72) Inventors: Eric P. Avar, Lake Oswego, OR (US); Fanny Yung Ho, Portland, OR (US); Daniel A. Johnson, Portland, OR (US); Peter R. Savage, Aloha, OR (US); Summer L. Schneider, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 18/100,907

(22) Filed: Jan. 24, 2023

(65) Prior Publication Data

US 2023/0157415 A1 May 25, 2023

Related U.S. Application Data

(62) Division of application No. 17/092,555, filed on Nov. 9, 2020, now Pat. No. 11,571,043, which is a division
(Continued)

(51) Int. Cl.
*A43C 1/00* (2006.01)
*A43B 13/14* (2006.01)
(Continued)

(52) U.S. Cl.
CPC ..... *A43C 1/003* (2013.01); *A43B 13/14* (2013.01); *A43B 23/0265* (2013.01); *A43B 23/26* (2013.01); *A43C 11/165* (2013.01)

(58) Field of Classification Search
CPC ..... A43B 23/26; A43C 11/165; A43C 11/20
(Continued)

(56) References Cited

U.S. PATENT DOCUMENTS 64,155 A 4/1867 Sickels et al.
749,569 A * 1/1904 Luks ..... A43C 7/00 24/712
(Continued)

FOREIGN PATENT DOCUMENTS

CN 1939179 4/2007
CN 102014682 4/2011
(Continued)

OTHER PUBLICATIONS

"European Application Serial No. 22187620.4, Communication Pursuant to Article 94(3) EPC mailed Sep. 29, 2023", 9 pgs.
(Continued)

*Primary Examiner* — Ted Kavanaugh
(74) *Attorney, Agent, or Firm* — Schwegman, Lundberg & Woessner, P.A.

(57) ABSTRACT

Systems and apparatus related to an automated footwear platform including an actuator assembly for controlling a footwear lacing apparatus are discussed. In an example, an Lacing architectures for automated footwear assemblies are discussed. In an example, a footwear assembly can include a floating tongue within an upper assembly. The lacing architecture can include a first plurality or lace guides forming a first lacing zone and a second plurality of lace guides forming a second lacing zone. The lacing architecture can also include a tongue lace guide assembly secure to a proximal portion of the floating tongue.

10 Claims, 11 Drawing Sheets

Related U.S. Application Data of application No. 16/165,023, filed on Oct. 19, 2018, now Pat. No. 10,856,618.

(60) Provisional application No. 62/634,358, filed on Feb. 23, 2018, provisional application No. 62/574,940, filed on Oct. 20, 2017.

(51) Int. Cl.
*A43B 23/02* (2006.01)
*A43B 23/26* (2006.01)
*A43C 11/16* (2006.01)

(58) Field of Classification Search
USPC ..... 24/713.4, 714.4
See application file for complete search history.

(56) References Cited

U.S. PATENT DOCUMENTS 811,872 A * 2/1906 Ries ..... A43C 1/00 24/712
1,386,985 A * 8/1921 Bowers ..... A43C 11/20 24/713.3
2,109,751 A * 3/1938 Matthias ..... A43B 5/0486 36/99
3,169,325 A * 2/1965 Fesl ..... A43C 11/20 36/99
3,808,644 A 5/1974 Schoch
4,937,952 A * 7/1990 Olivieri ..... A43C 11/16 36/118.9
5,177,882 A * 1/1993 Berger ..... A43C 11/165 36/50.1
5,566,474 A 10/1996 Leick et al.
5,791,021 A 8/1998 James
5,791,068 A 8/1998 Bernier et al.
5,934,599 A 8/1999 Hammerslag
5,983,530 A 11/1999 Chou
6,032,387 A 3/2000 Johnson
6,158,096 A * 12/2000 Bar ..... A43C 11/20 24/712.9
6,691,433 B2 2/2004 Liu
6,896,128 B1 5/2005 Johnson
7,721,468 B1 5/2010 Johnson et al.
7,752,774 B2 7/2010 Ussher
8,418,381 B2 4/2013 Reagan et al.
8,739,373 B1 * 6/2014 Berman ..... A43C 7/04 24/712.6
8,904,672 B1 12/2014 Johnson
9,693,605 B2 7/2017 Beers
9,861,165 B2 1/2018 Schneider et al.
9,961,963 B2 5/2018 Schneider et al.
10,856,618 B2 12/2020 Avar et al.
11,571,043 B2 2/2023 Avar et al.
2002/0083621 A1 7/2002 Durocher
2002/0095750 A1 7/2002 Hammerslag
2003/0204938 A1 11/2003 Hammerslag
2005/0097780 A1 * 5/2005 Pellegrini ..... A43C 7/08 36/50.1
2005/0210706 A1 9/2005 Johnson
2007/0068040 A1 3/2007 Farys
2007/0169380 A1 * 7/2007 Borsoi ..... A43C 7/08 36/114
2007/0240334 A1 10/2007 Johnson
2008/0172848 A1 * 7/2008 Chen ..... A43C 11/165 24/68 SK
2008/0301919 A1 12/2008 Ussher
2008/0307673 A1 12/2008 Johnson
2009/0272007 A1 11/2009 Beers et al.
2010/0319216 A1 * 12/2010 Grenzke ..... A43C 11/165 36/50.1
2011/0099844 A1 * 5/2011 Flannery ..... A43C 11/20 12/142 LC
2011/0296712 A1 * 12/2011 Settele ..... A43B 5/002 36/50.1
2013/0086816 A1 4/2013 Johnson et al.
2014/0068838 A1 3/2014 Beers et al.
2014/0082963 A1 3/2014 Beers
2015/0047230 A1 2/2015 Beers
2016/0106183 A1 * 4/2016 Roberson ..... A43B 1/0027 36/136
2016/0345680 A1 * 12/2016 Rhulen ..... A43C 3/00
2017/0265579 A1 9/2017 Schneider et al.
2017/0265580 A1 9/2017 Schneider et al.
2017/0265593 A1 9/2017 Schneider et al.
2018/0110294 A1 4/2018 Schneider et al.
2018/0110298 A1 4/2018 Schneider et al.
2018/0199671 A1 7/2018 Schneider et al.
2018/0199673 A1 7/2018 Schneider et al.
2018/0263338 A1 9/2018 Amis et al.
2018/0289110 A1 10/2018 Bock et al.
2018/0368526 A1 12/2018 Bock et al.
2019/0116935 A1 4/2019 Avar et al.
2020/0170352 A1 6/2020 Avar et al.
2021/0120917 A1 4/2021 Avar et al.

FOREIGN PATENT DOCUMENTS

CN 102821635 12/2012
CN 103156331 6/2013
CN 203505737 4/2014
CN 104582519 4/2015
CN 110099584 8/2019
CN 111278319 6/2020
CN 114652053 6/2022
DE 3900777 7/1990
DE 102005036013 2/2007
EP 3697251 8/2022
JP H0751103 2/1995
JP 2006502797 1/2006
JP 2021500120 1/2021
JP 7245240 3/2023
KR 20200058591 5/2020
KR 20210071092 6/2021
KR 102587399 B1 10/2023
KR 20230145520 A 10/2023
TW 521593 2/2003
TW 201739371 11/2017
WO 2004034831 4/2004
WO 2009071652 6/2009
WO 2017160558 9/2017
WO 2019079673 4/2019

OTHER PUBLICATIONS

"European Application Serial No. 22187620.4, Response filed Jun. 30, 2023 to Extended European Search Report mailed Dec. 13, 2022", 31 pgs.
"International Application Serial No. PCT US2017 021393, International Search Report mailed Jun. 16, 2017", 4 pgs.
"International Application Serial No. PCT US2017 021393, Written Opinion mailed Jun. 16, 2017", 6 pgs.
"U.S. Appl. No. 15/452,636, Restriction Requirement mailed Jul. 6, 2017", 6 pgs.
"U.S. Appl. No. 15/610,151, Non Final Office Action mailed Jul. 12, 2017", 15 pgs.
"U.S. Appl. No. 15/452,636, Response filed Sep. 6, 2017 to Restriction Requirement mailed Jul. 6, 2017", 7 pgs . . . .
"U.S. Appl. No. 15/452,636, Non Final Office Action mailed Sep. 15, 2017", 17 pgs.
"U.S. Appl. No. 15/610,151, Response filed Sep. 27, 2017 to Non Final Office Action mailed Jul. 12, 2017", 14 pgs.
"U.S. Appl. No. 15/610,151, Preliminary Amendment filed Jun. 28, 2017", 6 pgs.
"U.S. Appl. No. 15/610,151, Notice of Allowance mailed Oct. 24, 2017", 8 pgs.
"U.S. Appl. No. 15/452,636, Response filed Dec. 15, 2017 to Non Final Office Action mailed Sep. 15, 2017", 17 pgs.
"Taiwanese Application Serial No. 106108511, Office Action mailed Dec. 5, 2017", With English translation, 16 pgs.

(56) References Cited

OTHER PUBLICATIONS

"U.S. Appl. No. 15/452,636, Notice of Allowance mailed Feb. 12, 2018", 10 pgs.
"Taiwanese Application Serial No. 106108511, Response filed Mar. 5, 2018 to Office Action mailed Dec. 5, 2017", With English claims, 110 pgs.
"International Application Serial No. PCT US2018 056631, International Search Report mailed Feb. 8, 2019", 3 pgs.
"International Application Serial No. PCT US2018 056631, Written Opinion mailed Feb. 8, 2019", 5 pgs.
"U.S. Appl. No. 16/165,023, Restriction Requirement mailed Mar. 20, 2020", 5 pgs.
"International Application Serial No. PCT US2018 056631, International Preliminary Report on Patentability mailed Apr. 30, 2020", 7 pgs.
"U.S. Appl. No. 16/165,023, Response filed Jun. 19, 2020 to Restriction Requirement mailed Mar. 20, 2020", 8 pgs.
"U.S. Appl. No. 16/165,023, Notice of Allowance mailed Aug. 3, 2020", 12 pgs.
"Korean Application Serial No. 10-2020-7014339, Notice of Preliminary Rejection mailed Jul. 31, 2020", w English translation, 8 pgs.
"U.S. Appl. No. 16/165,023, Corrected Notice of Allowability mailed Nov. 12, 2020", 2 pgs.
"Japanese Application Serial No. 2020-521956, Notification of Reasons for Refusal mailed Nov. 17, 2020", w English translation, 10 pgs.
"European Application Serial No. 18867964.1, Response to Communication Pursuant to Rules 161 and 162 filed Nov. 9, 2020", 10 pgs.
"U.S. Appl. No. 17/092,555, Preliminary Amendment filed Jan. 18, 2021", 6 pgs.
"Korean Application Serial No. 10-2020-7014339, Response filed Jan. 11, 2021 to Notice of Preliminary Rejection mailed Jul. 31, 2020", w English claims, 14 pgs.
"Chinese Application Serial No. 201880068332.X, Office Action mailed Dec. 31, 2020", w English translation, 13 pgs.
"Japanese Application Serial No. 2020-521956, Response filed Jan. 29, 2021 to Notification of Reasons for Refusal mailed Nov. 17, 2020", w English Claims, 17 pgs.
"Japanese Application Serial No. 2020-521956, Examiners Decision of Final Refusal mailed Mar. 30, 2021", w English Translation, 7 pgs.
"European Application Serial No. 18867964.1, Extended European Search Report mailed May 19, 2021", 10 pgs.
"Chinese Application Serial No. 201880068332.X, Response filed Jul. 14, 2021 to Office Action mailed Dec. 31, 2020", w English claims, 76 pgs.
"Japanese Application Serial No. 2020-521956, Response filed Jul. 27, 2021 to Examiners Decision of Final Refusal mailed Mar. 30, 2021", With English claims, 7 pgs.
"European Application Serial No. 18867964.1, Response filed Dec. 17, 2021 to Extended European Search Report mailed May 19, 2021", 23 pgs.
"Chinese Application Serial No. 202111346221.0, Notification to Make Rectification mailed Jan. 4, 2022", With English machine translation, 3 pgs.
"U.S. Appl. No. 17/092,555, Restriction Requirement mailed Mar. 4, 2022", 5 pgs.
"Chinese Application Serial No. 202111346221.0, Response filed Mar. 4, 2022 to Notification to Make Rectification mailed Jan. 4, 2022", w English claims, 64 pgs.
"Chinese Application Serial No. 202111346221.0, Notification to Make Rectification mailed Mar. 21, 2022", With English machine translation, 3 pgs.
"U.S. Appl. No. 17/092,555, Response filed Apr. 29, 2022 to Restriction Requirement mailed Mar. 4, 2022", 6 pgs.
"Japanese Application Serial No. 2020-521956, Notification of Reasons for Refusal mailed May 17, 2022", w English translation, 4 pgs.
"U.S. Appl. No. 17/092,555, Non Final Office Action mailed May 31, 2022", 12 pgs.
"Chinese Application Serial No. 202111346221.0, Response filed May 23, 2022 to Notification to Make Rectification mailed Mar. 21, 2022", w English claims, 63 pgs.
"U.S. Appl. No. 17/092,555, Response filed Aug. 31, 2022 to Non Final Office Action mailed May 31, 2022", 12 pgs.
"U.S. Appl. No. 17/092,555, Notice of Allowance mailed Oct. 13, 2022", 7 pgs.
"Japanese Application Serial No. 2020-521956, Notification of Reasons for Refusal mailed Dec. 13, 2022", w English translation, 4 pgs.
"European Application Serial No. 22187620.4, Extended European Search Report mailed Dec. 13, 2022", 12 pgs.
"Japanese Application Serial No. 2020-521956, Response filed Nov. 1, 2022 to Notification of Reasons for Refusal mailed May 17, 2022", w English claims, 8 pgs.
"Japanese Application Serial No. 2020-521956, Response filed Dec. 20, 2022 to Notification of Reasons for Refusal mailed Dec. 13, 2022", w English claims, 7.
"European Application Serial No. 22187620.4, Response Filed Jan. 29, 2024 to Communication Pursuant to Article 94(3) EPC mailed Sep. 29, 2023", 18 pages.
"European Application Serial No. 22187620.4, Communication Pursuant to Article 94(3) EPC mailed Apr. 19, 2024", 9 pgs.
"Korean Application Serial No. 10-2023-7033819, Notice of Preliminary Rejection mailed Jun. 13, 2024", w English Translation, 6 pgs.

* cited by examiner

LACING ARCHITECTURE FOR AUTOMATED FOOTWEAR PLATFORM

RELATED APPLICATIONS

This application is a divisional application of U.S. patent application Ser. No. 17/092,555, filed Nov. 9, 2020, which application is a division of U.S. patent application Ser. No. 16/165,023, filed Oct. 19, 2018, now U.S. Pat. No. 10,856,618, issued on Dec. 8, 2020, which application claims the benefit of priority to U.S. Provisional Patent Application Ser. No. 62/634,358, filed Feb. 23, 2018 and U.S. Provisional Patent Application Ser. No. 62/574,940, filed Oct. 20, 2017, the contents of all which are hereby incorporated by reference in their entireties.

The following specification describes various aspects of a footwear assembly involving a lacing system including a motorized or non-motorized lacing engine, footwear components related to the lacing engines, automated lacing footwear platforms, and lacing architectures for use in an automated footwear platform. More specifically, much of the following specification describes various aspects of lacing architectures (configurations) for use in footwear including motorized or non-motorized lacing engines for centralized lace tightening.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

Figure 1:
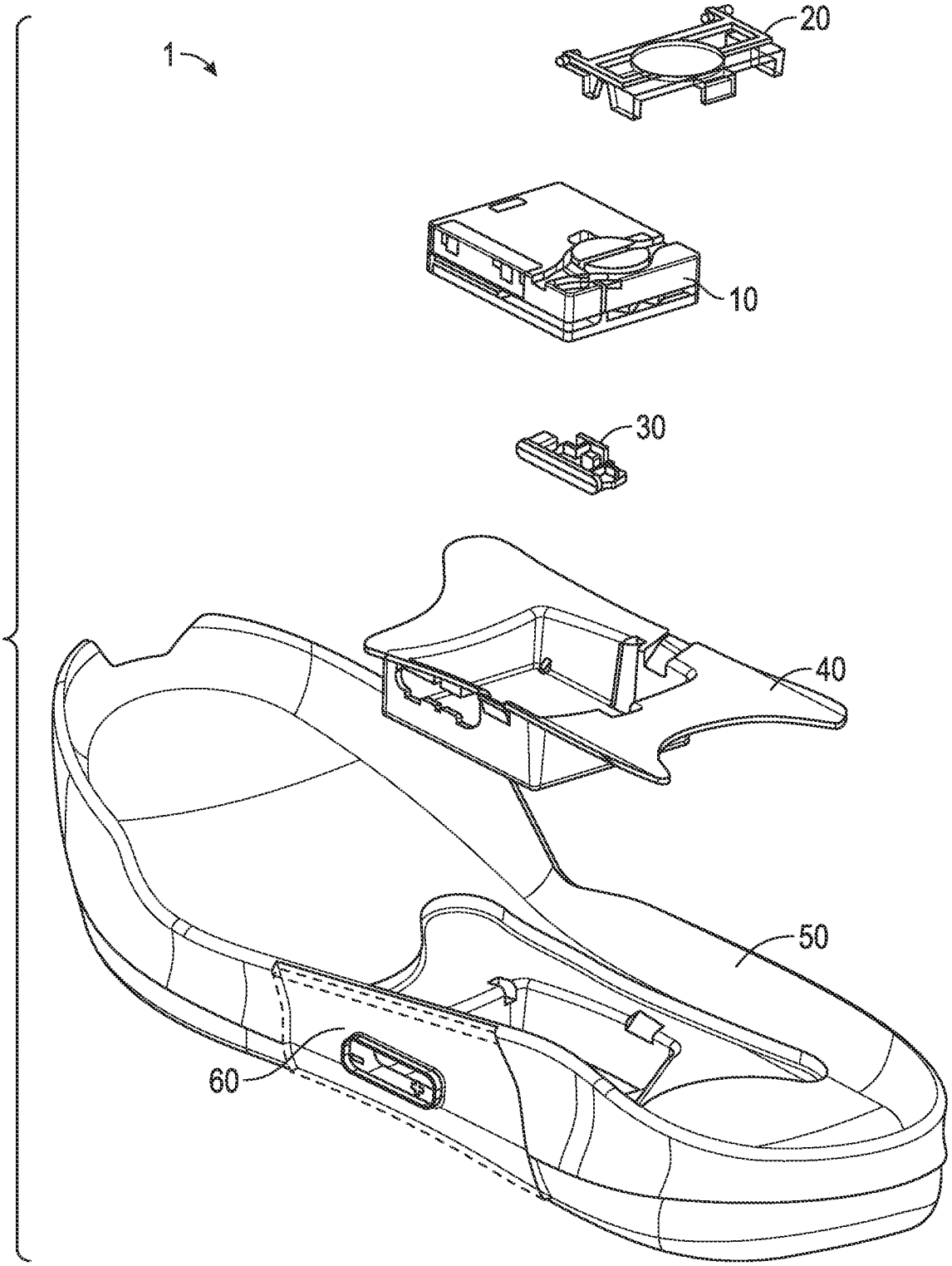
FIG. 1 is an exploded view illustration of components of a portion of a footwear assembly with a motorized lacing system, according to some example embodiments.

Any headings provided herein are merely for convenience and do not necessarily affect the scope or meaning of the terms used or discussion under the heading.

DETAILED DESCRIPTION

The concept of self-tightening shoe laces was first widely popularized by the fictitious power-laced Nike® sneakers worn by Marty McFly in the movie Back to the Future II, which was released back in 1989. While Nike® has since released at least one version of power-laced sneakers similar in appearance to the movie prop version from Back to the Future II, the internal mechanical systems and surrounding footwear platform employed do not necessarily lend themselves to mass production or daily use. Additionally, other previous designs for motorized lacing systems comparatively suffered from problems such as high cost of manufacture, complexity, assembly challenges, and poor serviceability. The present inventors have developed a lacing architecture for use on a modular footwear platform to accommodate motorized and non-motorized lacing engines that assists in solving some or all of the problems discussed above, among others. The lacing architectures and lace guides discussed herein also focus on improving fit and comfort when used in conjunction with an automated lacing engine. In order to fully leverage the modular lacing engine discussed briefly below and in greater detail in co-pending application Ser. No. 15/452,636, titled "LACING ENGINE FOR AUTOMATED FOORWEAR PLATFORM," which is hereby incorporated by reference in its entirety, the present inventors developed lacing architectures discussed herein. The lacing architectures and lace guides discussed herein can solve various problems experienced with centralized lace tightening mechanisms, such as uneven tightening, fit, comfort, and performance. One aspect of enhanced comfort involves a lacing architecture that reduces pressure across the top of the foot. Example lacing architectures can also enhance fit and performance by manipulating lace tension in both a medial-lateral direction as well as in an anterior-posterior (front to back) direction. Another example lacing architecture discussed below splits the lacing system into two zones to provide better fit, performance and comfort by separating the toe (forefoot) area from the mid-foot area. Various other benefits of the components described below will be evident to persons of skill in the relevant arts.

The lacing architectures discussed were developed specifically to interface with a modular lacing engine positioned within a mid-sole portion of a footwear assembly. However, the concepts could also be applied to motorized and manual lacing mechanisms disposed in various locations around the footwear, such as in the heel or even the toe portion of the footwear platform. The lacing architectures discussed include use of lace guides that can be formed from tubular plastic, metal clip, fabric loops or channels, plastic clips, and open u-shaped channels, among other shapes and materials. In some examples, various different types of lacing guides can be mixed to perform specific lace routing functions within the lacing architecture. Certain examples of specific lace guide configurations are discussed in detail below.

The motorized lacing engine discussed below was developed from the ground up to provide a robust, serviceable, and inter-changeable component of an automated lacing footwear platform. The lacing engine includes unique design elements that enable retail-level final assembly into a modular footwear platform. The lacing engine design allows for the majority of the footwear assembly process to leverage known assembly technologies, with unique adaptions to standard assembly processes still being able to leverage current assembly resources.

In an example, the modular automated lacing footwear platform includes a mid-sole plate secured to the mid-sole for receiving a lacing engine. The design of the mid-sole plate allows a lacing engine to be dropped into the footwear platform as late as at a point of purchase. The mid-sole plate, and other aspects of the modular automated footwear platform, allow for different types of lacing engines to be used interchangeably. For example, the motorized lacing engine discussed below could be changed out for a human-powered lacing engine. Alternatively, a fully automatic motorized lacing engine with foot presence sensing or other optional features could be accommodated within the standard mid-sole plate. The lacing architectures are specifically designed to assist in interfacing a lace cable (or similar lacing element) with a lacing engine.

Utilizing motorized or non-motorized centralized lacing engines to tighten athletic footwear presents some challenges in providing sufficient performance without sacrificing some amount of comfort. Lacing architectures discussed herein have been designed specifically for use with centralized lacing engines, and are designed to enable various footwear designs from casual to high-performance.

Footwear terminology used in this disclosure includes terms such as floating textile layer, outer layer, shoe upper, bonding material, and eyestay, which are all further defined in a co-pending application Ser. No. 15/459,932, titled "SHOE UPPER WITH FLOATING LAYER", that is hereby incorporated by reference in its entirety. The floating textile layer is a term used, in an example, to describe an inner sock-like structure that essentially floats within an outer layer of an upper portion of a footwear assembly. The floating textile layer can be attached to the mid-sole of the footwear assembly and may be minimally attached at select places to portions of an upper portion as well. In certain examples, the floating textile layer can be made from material with no-stretch or limited stretch properties. In some examples, the material of the floating textile layer is a quad-axial, tri-axial, or non-woven material.

The outer layer is a second layer of a footwear upper (or shoe upper) that covers the floating textile layer and substantially accounts for the outside shell of the shoe upper. In some examples, the outer layer is an outer knit shell. The outer layer can also be made in whole or in part from polyurethane, leather, cast urethane, or digitally printed urethane as well as knit, woven, braided, or non-woven materials.

A bonding material is typically used to reinforce portions of a footwear assembly, such as edges of the outer layer or floating textile layer, among others. The eyestay is a term used, in some examples, to describe an area on the footwear upper adapted to receive eyelets or lace guides. In some examples, the eyestay area can be reinforced with bonding or similar materials.

This initial overview is intended to introduce the subject matter of the present patent application. It is not intended to provide an exclusive or exhaustive explanation of the various inventions disclosed in the following more detailed description.

Automated Footwear Platform

The following discusses various components of the automated footwear platform including a motorized lacing engine, a mid-sole plate, and various other components of the platform. While much of this disclosure focuses on lacing architectures for use with a motorized lacing engine, the discussed designs are applicable to a human-powered lacing engine or other motorized lacing engines with additional or fewer capabilities. Accordingly, the term "automated" as used in "automated footwear platform" is not intended to only cover a system that operates without user input. Rather, the term "automated footwear platform" includes various electrically powered and human-powered, automatically activated and human activated mechanisms for tightening a lacing or retention system of the footwear.

FIG. 1 is an exploded view illustration of components of a motorized lacing system for footwear, according to some example embodiments. The motorized lacing system 1 illustrated in FIG. 1 includes a lacing engine 10, a lid 20, an actuator 30, a mid-sole plate 40, a mid-sole 50, and an outsole 60. FIG. 1 illustrates the basic assembly sequence of components of an automated lacing footwear platform. The motorized lacing system 1 starts with the mid-sole plate 40 being secured within the mid-sole. Next, the actuator 30 is inserted into an opening in the lateral side of the mid-sole plate opposite to interface buttons that can be embedded in the outsole 60. Next, the lacing engine 10 is dropped into the mid-sole plate 40. In an example, the lacing system 1 is inserted under a continuous loop of lacing cable and the lacing cable is aligned with a spool in the lacing engine 10 (discussed below). Finally, the lid 20 is inserted into grooves in the mid-sole plate 40, secured into a closed position, and latched into a recess in the mid-sole plate 40. The lid 20 can capture the lacing engine 10 and can assist in maintaining alignment of a lacing cable during operation.

In an example, the footwear article or the motorized lacing system 1 includes or is configured to interface with one or more sensors that can monitor or determine a foot presence characteristic. Based on information from one or more foot presence sensors, the footwear including the motorized lacing system 1 can be configured to perform various functions. For example, a foot presence sensor can be configured to provide binary information about whether a foot is present or not present in the footwear. If a binary signal from the foot presence sensor indicates that a foot is present, then the motorized lacing system 1 can be activated, such as to automatically tighten or relax (i.e., loosen) a footwear lacing cable. In an example, the footwear article includes a processor circuit that can receive or interpret signals from a foot presence sensor. The processor circuit can optionally be embedded in or with the lacing engine 10, such as in a sole of the footwear article.

Footwear Assembly

Figure 2A:
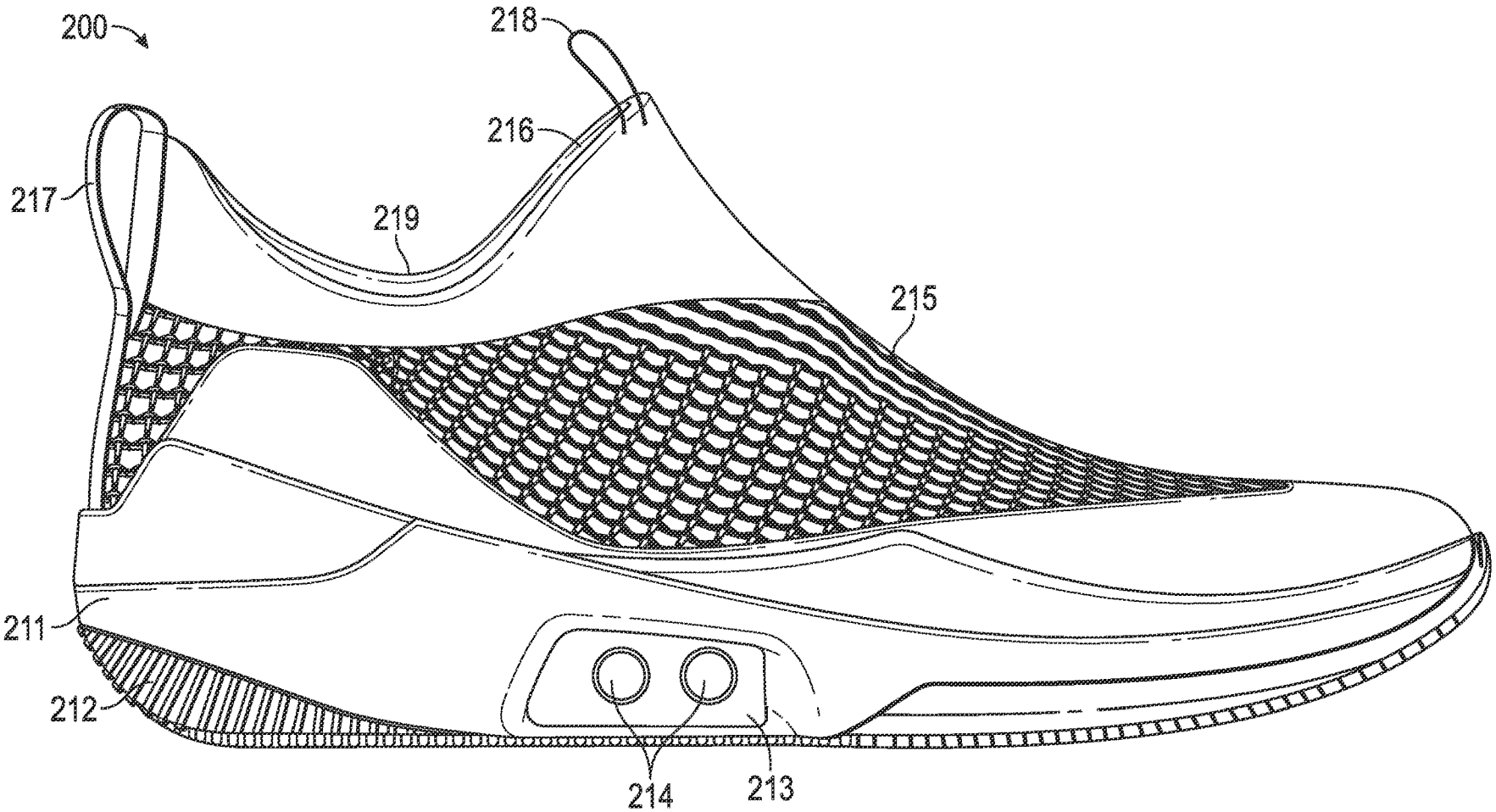
FIGS. 2A-2C are illustrations of a fully assembled footwear assembly including automated lace tightening, according to some example embodiments.
Figure 2B:
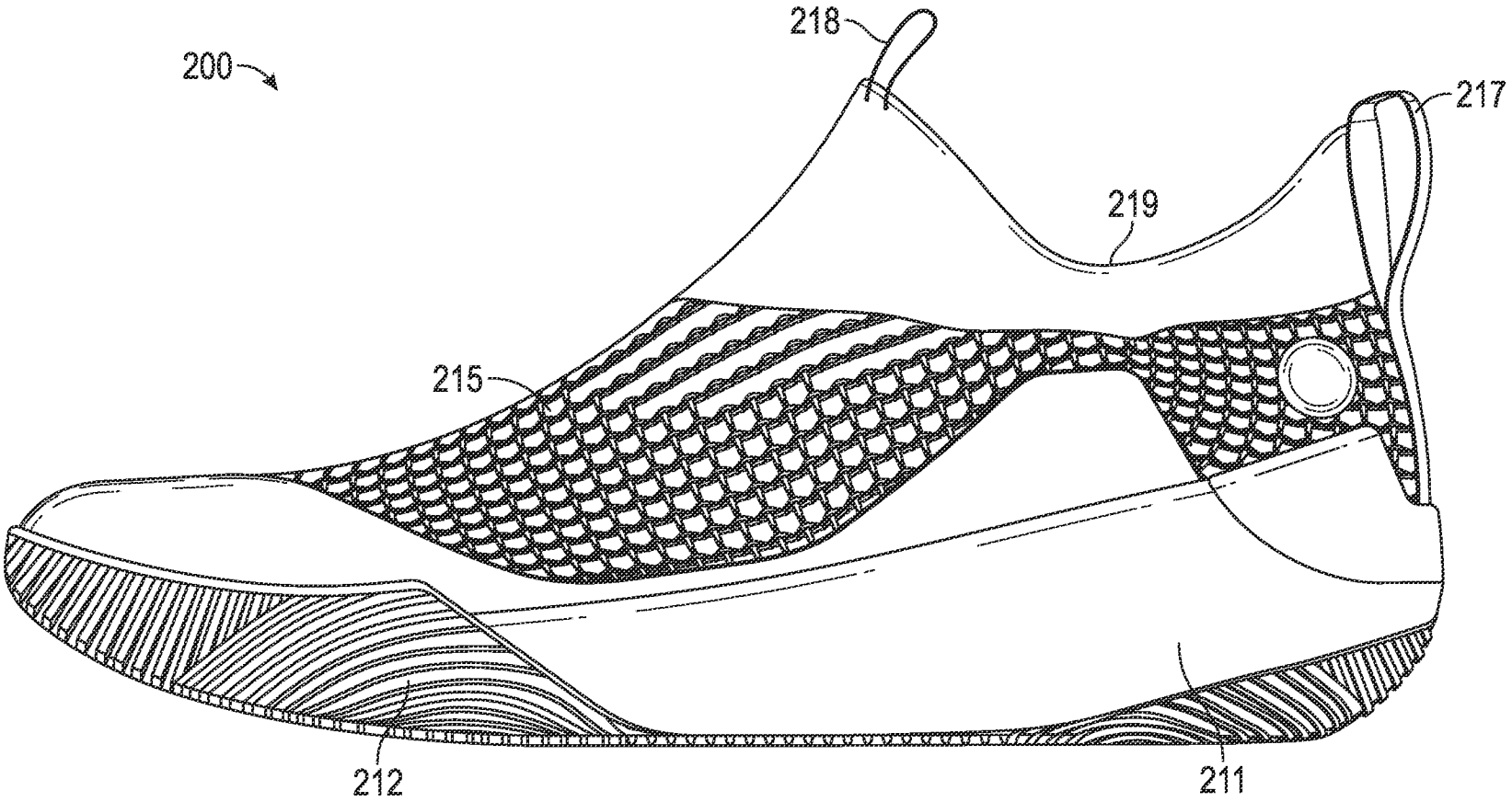
Figure 2C:
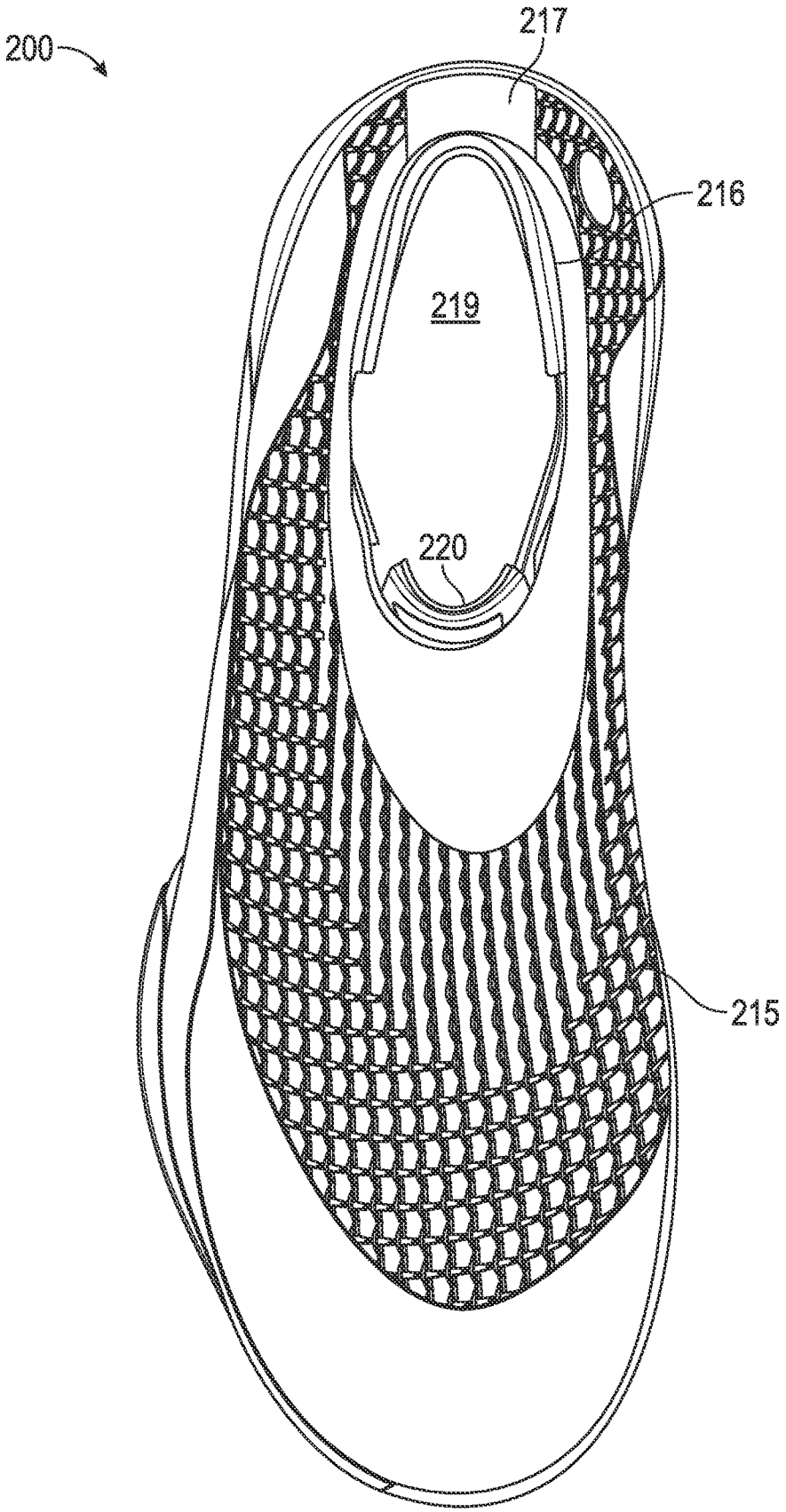

FIGS. 2A-2C are illustrations of a fully assembled footwear assembly including automated lace tightening, according to some example embodiments. In the example illustrated in FIG. 2A, the footwear assembly 200 includes a mid-sole 211, an out-sole 212, a mid-sole plate 213, actuator buttons 214, a footwear upper including an outer layer 215 and a floating textile layer 216, a heel pull 217, a tongue pull 218, and a foot opening 219. In this example, only an upper edge of the floating textile layer 216 is visible, but the floating textile layer essentially lines the inside of the outer layer 215.

However, as implied by the "floating" term, the floating textile layer 216 is only secured to the outer layer 215 minimally along certain locations, such as along an eyestay, a central throat portion, or around lace guide attachment points. In some examples, the floating textile layer 216 is also (or alternatively) attached to the inside along a periphery of the mid-sole 211. Details of an example footwear construction technique that could be used to produce the footwear assembly illustrated in FIGS. 2A-2C is disclosed in the co-pending application mentioned above, application Ser. No. 15/459,932, and will not be repeated here.

In this example, a small outer portion of the mid-sole plate 213 is exposed through a cut-out in the mid-sole 211. In other examples, only the actuator buttons 214 may be exposed through the side of the mid-sole 211. The mid-sole plate 213 is adapted to retain and protect a lacing engine within the mid-sole 211 of the footwear assembly 200.

FIG. 2B illustrates a medial view of footwear assembly 200. In this example, the footwear assembly 200 is depicted as including out-sole 212, mid-sole 211, outer layer 215, heel pull 217, tongue pull 218, and foot opening 219. The outer layer 215, in this example, is a knit outer shell covering the floating textile layer 216 and all lacing components, such as the lacing components discussed in reference to FIGS. 3A-3B below.

FIG. 2C illustrates a top view of footwear assembly 200, which includes illustration of outer layer 215, floating textile layer 216, heel pull 217, foot opening 219, and a floating tongue 220. In this example, the floating tongue 220 can be attached only at a distal end or only at a distal end and a proximal end adjacent the foot opening 219.

Lacing Architectures

Figure 3A:
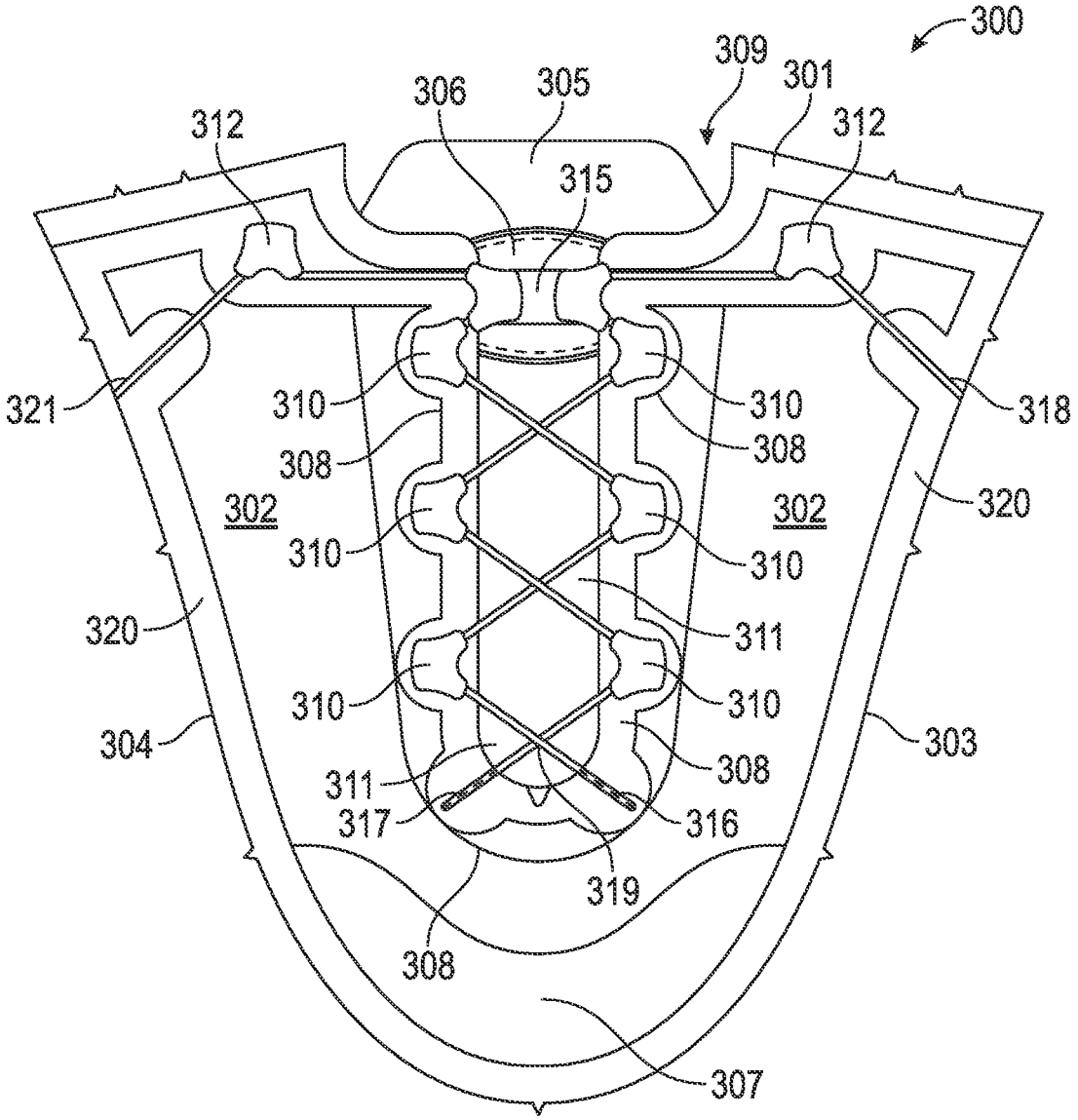
FIGS. 3A-3B are top-view diagrams illustrating a lacing architecture for use with footwear assemblies including a motorized lacing engine, according to some example embodiments.
Figure 3B:
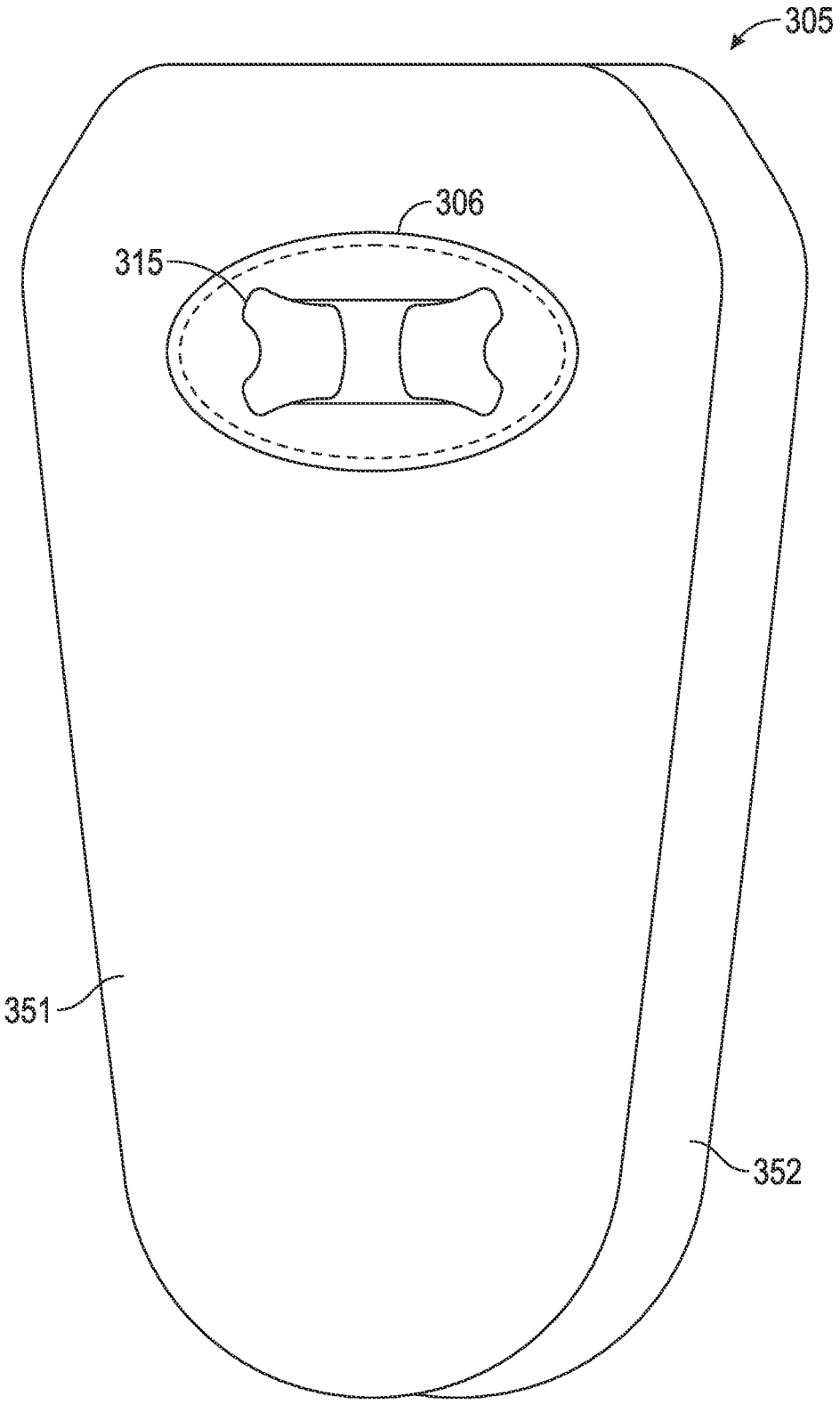

FIGS. 3A-3B are top-view diagrams illustrating a lacing architecture for use with footwear assemblies including a motorized lacing engine, according to some example embodiments. FIG. 3A is a top-view diagram illustrating a flattened footwear upper with a lacing architecture for use with a lacing engine, according to some example embodiments. In this example, the footwear upper 300 has a medial side 303 and a lateral side 303, as well as a distal end and a proximal end. The distal end includes a toe box section 307 and the proximal end includes a heel portion. The footwear upper 300 also includes a floating textile layer 301, an outer layer 302, and a floating tongue 305. The floating tongue 305 extends out of the foot opening 309 of the outer layer 302 proximate a throat portion 311 formed from a U-shaped cut-out in at least the outer layer 302. In other examples, the throat portion 311 can be integrated into a covered layer of the outer layer 302, so the throat portion 311 and the lacing architecture is concealed from external view. In some examples, the throat portion 311 is also cut-out of the floating textile layer 301. In this example, the outer layer 302 can include an outer layer border 320. The outer layer border 320 can be a bonding material or some similar reinforcing structure. In some examples, the knit outer shell outer layer can be bonded directly to the mid-sole without an outer layer border.

In this example, the lacing architecture comprises a series of lace guides 310 that route a lace cable 319 in a crisscross pattern over the throat portion 311. A crisscross lacing pattern is one that alternates between medial and lateral side lace guides across a centerline of the footwear assembly. The lace cable 319 can be fixed at a medial lace termination 316 and a lateral lace termination 317, which creates a lace loop that is routed by the lacing architecture to engage a lacing engine housed within a mid-sole of the footwear assembly. The lacing engine can be located in various locations throughout the footwear assembly, but is discussed for exemplary purposes only as being more or less centered under the arch within the mid-sole.

In this example, the lacing architecture includes a tongue lace guide assembly 315 (or simply a tongue lace guide 315). The tongue lace guide 315 can include a medial facing lace guide and a lateral facing lace guide. The medial facing lace guide and the lateral facing lace guide can be molded or formed from a single piece of material or be separate structures coupled together in some manner. In certain examples, the medial facing lace guide and the lateral facing lace guide can be coupled together with an elastic member that allows for some separation between the lace guides upon application of tension on the lace cable 319. In certain examples, the medial facing lace guide and the lateral facing lace guide can be adhered to a tongue lace guide reinforcement 306. In yet other examples, the medial facing lace guide and the lateral facing lace guide are disposed on, wrapped in, or otherwise connected via a webbing material. The tongue lace guide reinforcement can be a no-stretch or limited-stretch material, a rigid material, or an elastic material. The tongue lace guide reinforcement 306 can be adhered, stitched, or similarly affixed to the floating tongue 305. In some examples, the tongue lace guide reinforcement 306 be padded or similarly constructed to distribute forces applied to the tongue lace guide across a wider area to avoid hot-spots for a user.

The lacing architecture can include multiple lace guides 310 distributed around a periphery of the throat portion 311 and affixed to an eyestay 308. The eyestay 308 can be a reinforced portion of the outer layer 302 or a separate structure affixed to the outer layer 302. The eyestay 308 can be a bonding material, as noted above. The lace guides 310 can be stitched, adhered, or otherwise affixed to the eyestay 308. The eyestay 308 can include enlarged areas to receive a lace guide 310, as illustrated in FIG. 3A. An example lace guide structure is discussed below in reference to FIGS. 4A-4F.

In the illustrated lacing architecture example, the lace guides 310 route the lace cable 319 proximally along a periphery of the throat portion 311 in a crisscross fashion. From the lace guides 310, the lace cable 319 is routed into the tongue lace guide 315, which in turn routes the lace cable 319 medially and laterally into heel lace guides 312. The heel lace guides 312 can be adhered or affixed to a heel counter as well as connected to a heel counter with an elastic connection or inelastic connection to distribute lace cable forces around a heel portion of the footwear assembly. From the heel lace guides 312 the lace cable 319 is routed into either a medial lace exit 318 or a lateral lace exit 319. The medial lace exit 318 and the lateral lace exit 319 route the lace cable 319 into a position to engage a lacing engine disposed in the mid-sole of the footwear assembly. The medial lace exit 318 and lateral lace exit 319 can be a molded lace guide, a fabric lace guide, a tubular lace guide, a channel molded into the mid-sole, or some similar structure capable of guiding the lace cable 319.

FIG. 3B is a diagram illustrating a floating tongue, according to an example embodiment. The floating tongue 305 includes a proximal end (top of figure) and a distal end (bottom of figure) as well as a medial side and a lateral side. In this example, the floating tongue 305 includes a tongue outer layer 351 and a tongue inner layer 352. The tongue outer layer 351 can be a similar material to the outer layer 302 of the footwear upper 300. The tongue inner layer 352 can be a similar material to the floating textile layer 301 of the footwear upper 300. In other examples, the tongue outer layer 351 and tongue inner layer 352 can be alternative materials and include padding or other features designed to enhance user comfort.

Figure 4A:
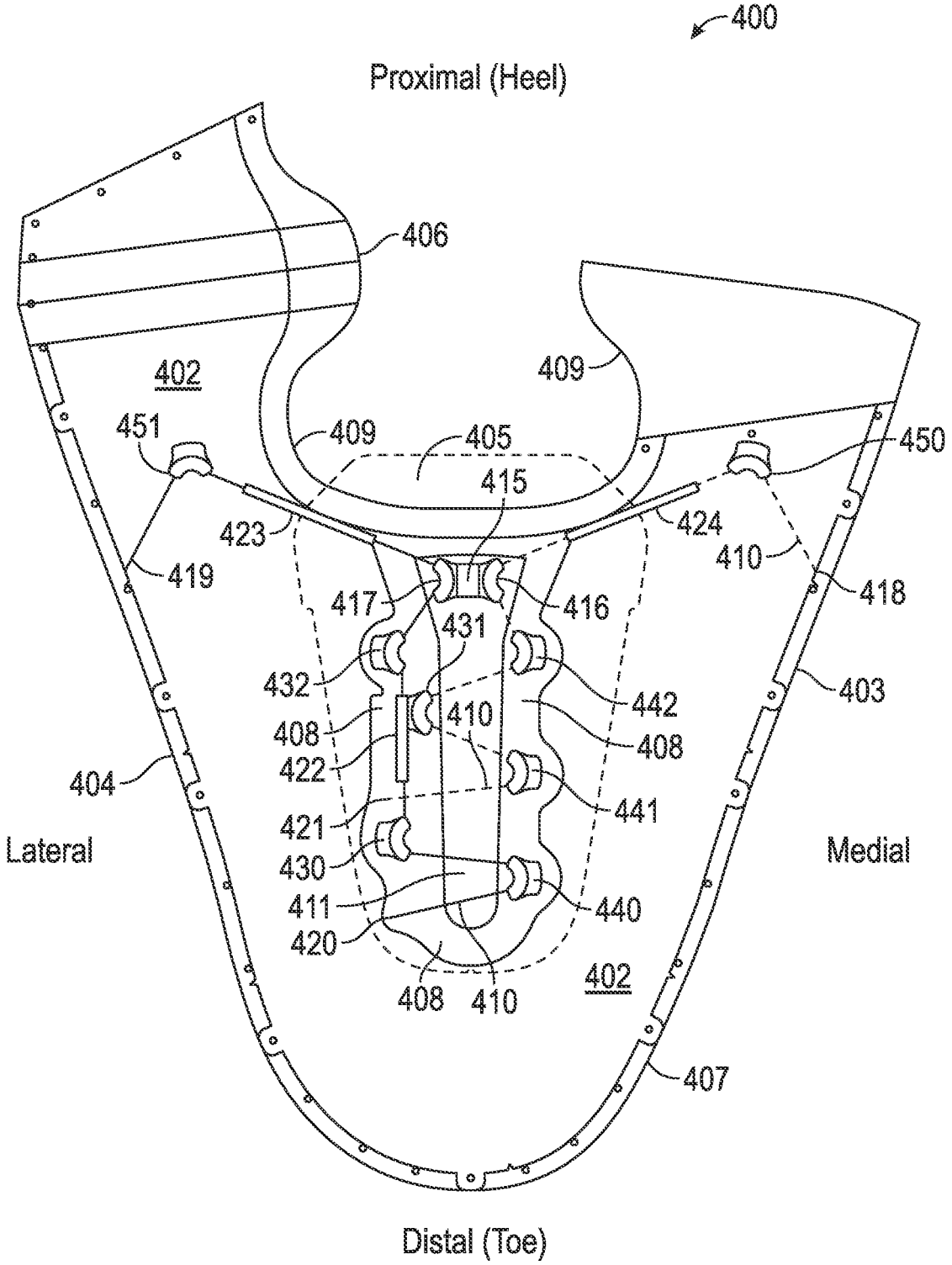
FIG. 4A is a top-view diagram illustrating a two-zone lacing architecture for use with footwear assemblies including a motorized or non-motorized lacing engine, according to some example embodiments.
Figure 4B:
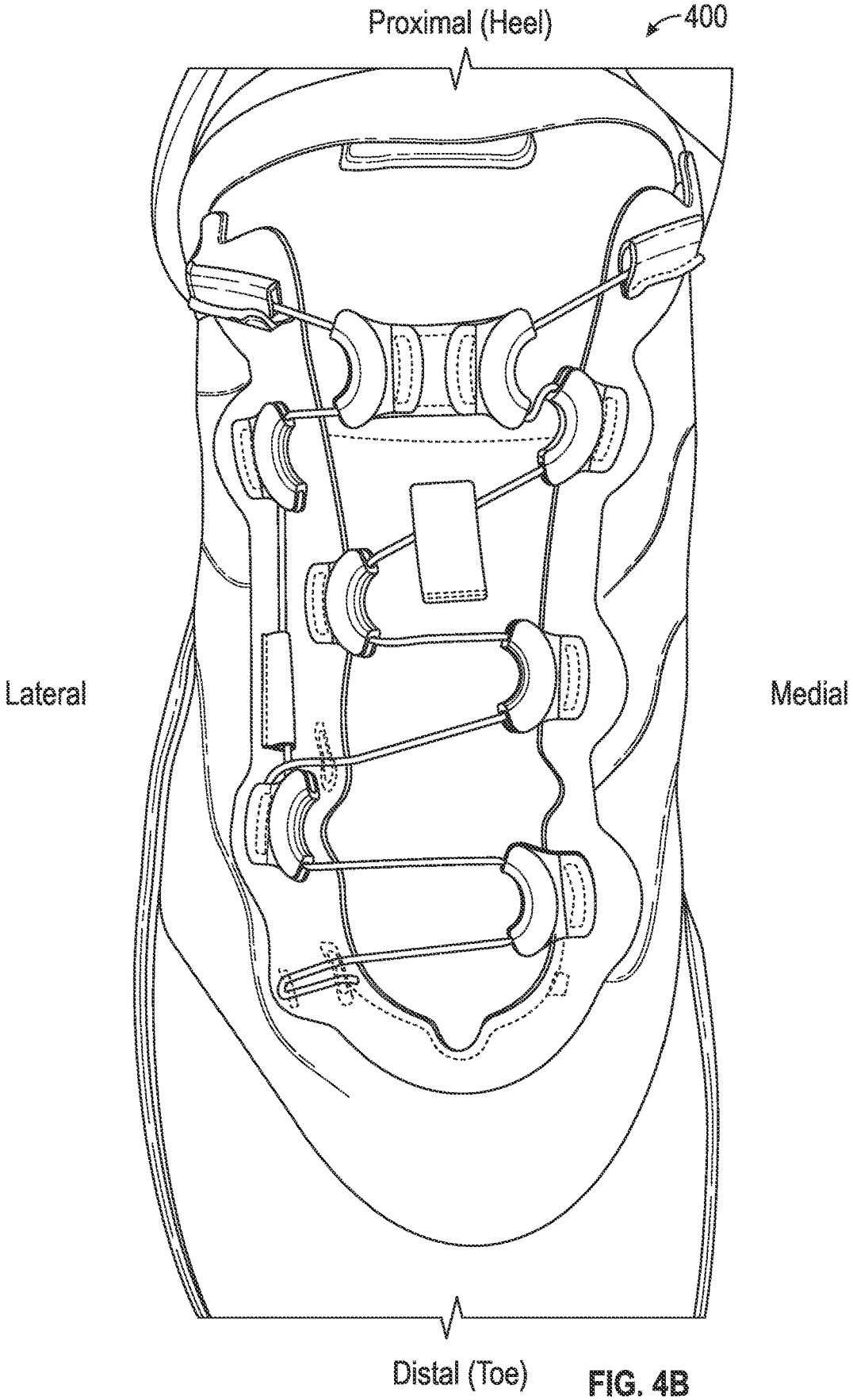
FIG. 4B is a photographic image of a footwear assembly utilizing a two-zone lacing architecture, according to some example embodiments.

FIG. 4A is a top-view diagram illustrating a flattened footwear upper 400 with a lacing architecture for use with a lacing engine, according to some example embodiments. FIG. 4B is a picture of an example footwear assembly utilizing the two-zone lacing architecture discussed in reference to FIG. 4A. In this example, the footwear upper 400 has a medial side 403 and a lateral side 404, as well as a distal (toe) end and a proximal (heel) end. The distal end includes a toe box section 407 and the proximal end includes a heel portion 406. The footwear upper 400 can also include a floating textile layer (optional, not illustrated), an outer layer 402, and a floating tongue 405. The floating tongue 405 extends out of the foot opening 409 of the outer layer 402 proximate a throat portion 411 (also referred to as a throat section) formed from a U-shaped cut-out in at least the outer layer 402. In some examples, the throat portion 411 varies in configuration, including various cut-out shapes or alternative material sections. All throat portions allow for portions of the lateral and medial sides of the footwear assembly to move in reference to each other. In other examples, the throat portion 411 can be integrated into a covered layer of the outer layer 402, so the throat portion 411 and the lacing architecture is concealed from external view. In some examples, the throat portion 411 is also cut-out of the floating textile layer. The footwear upper 400 can include some or all of the structures discussed in reference to footwear upper 300, but is illustrated in a more simplistic fashion to emphasize the two-zone lacing architecture.

In this example, the lacing architecture is split into two different zones. The first zone interacts with the toe or forefoot area of the footwear upper 400. The second zone interacts with the mid-foot area of the footwear upper 400. The first lacing zone lace cable is illustrated as a solid dark grey line, and the second lacing zone lace cable illustrated as a dotted black line. These differences are merely for illustrative purposes to assist in distinguishing the different lace cable paths, the lace cable in these details is a single cable running from termination 420 to termination 421 (terminations also referred to as anchor locations or anchor points). Alternatively, even in designs were the first lacing zone and the second lacing zone utilize different lace cables, the material used will typically be common between the different zones. The first lacing zone can include lace guides guiding the lace cable 410 from a first lace termination 420. In this example, the first lace termination 420 is located on a distal-lateral portion of eyestay 408. The lace cable 410 is routed from the first lace termination 420 across a distal end of throat portion 411 and through a first medial lace guide 440. From the first medial lace guide 440 the lace cable 410 is routed back over the throat portion 411 and through a first lateral lace guide 430. From the first lateral lace guide 430, the lace cable 410 is routed pass a second lateral lace guide 431 and though a third lateral lace guide 432. The lace guides are label first, second, third, etc . . . to signify an order running proximally from the distal end of the throat portion 411 towards the foot opening 409. Optionally, the lace cable 410 can route through a material guide 422 enroute from the first lateral lace guide 430 to the third lateral lace guide 432. From the third lateral lace guide 432, the lace cable 410 is routed through a lateral facing tongue lace guide 417 and down to a lateral heel lace guide 451 through an optional material guide 422. The lateral heel lace guide 451 routes the lace cable 410 into a mid-sole plate via lateral lace exit 419.

The second lacing zone includes a set of lace guides routing the lace cable 410 from the second termination 421 to the medial lace exit 418. In this example, the lace cable 410 is routed from the second termination 421 on the lateral side of eyestay 408 over the throat portion 411 to the second medial lace guide 441. From the second medial lace guide 441 the lace cable 410 is routed back over the throat portion 411 to the second lateral lace guide 431. The lace cable 410 then routes through the second lateral lace guide 431 back over the throat portion 411 for a third time and through the third medial lace guide 442. The third medial lace guide 442 routes the lace cable 410 on to the medial facing tongue lace guide 416, which routes the lace cable on towards the medial heel lace guide 450. Enroute to the medial heel lace guide 450 the lace cable can optionally be routed through a material lace guide 424. From the medial heel lace guide 450 the lace cable 410 is routed into the mid-sole plate via the medial lace exit 418.

The two-zone lacing architecture enables an uneven distribution of the lace cable tension between the distal end of the throat portion 411 and the proximal end. The first lacing zone applies the same lace cable tension across fewer lace guides, resulting the tension being distributed across a smaller area. The second lacing zone distributes the lace cable tension over a larger area with more lace guides The user experiences a tighter, higher performance fit in the toe (forefoot) area of the footwear with the two-zone lacing architecture. Other multi-zone lacing architectures can be utilized to vary the distribution of lace cable tension as desired for a particular footwear application.

Example Lace Guides

FIGS. 5A-5F are diagrams illustrating an example lacing guide 800 for use in certain lacing architectures, according to some example embodiments. In this example, an alternative lace guide with an open lace channel is illustrated. The lacing guide 800 described below can be substituted into any of the lacing architectures discussed above in reference to lace guide 810, heel lace guide 610, or even the medial exit guide 835. All of the various configurations discussed above will not be repeated here for the sake of brevity. The lacing guide 800 includes a guide tab 805, a stitch opening 810, a guide superior surface 815, a lace retainer 820, a lace channel 825, a channel radius 830, a lace access opening 840, a guide inferior surface 845, and a guide radius 850. Advantages of an open channel lace guide, such as lacing guide 800, include the ability to easily route the lace cable after installation of the lace guides on the footwear upper. With tubular lace guides as illustrated in many of the lace architecture examples discussed above, routing the lace cable through the lace guides is most easily accomplish before adhering the lace guides to the footwear upper (not to say it cannot be accomplished later). Open channel lace guides facilitate simple lace routing by allowing the lace cable to simply be pushed pass the lace retainer 820 after the lace guides 800 are positioned on the footwear upper. The lacing guide 800 can be fabricated from various materials including metal or plastics.

Figure 5A:
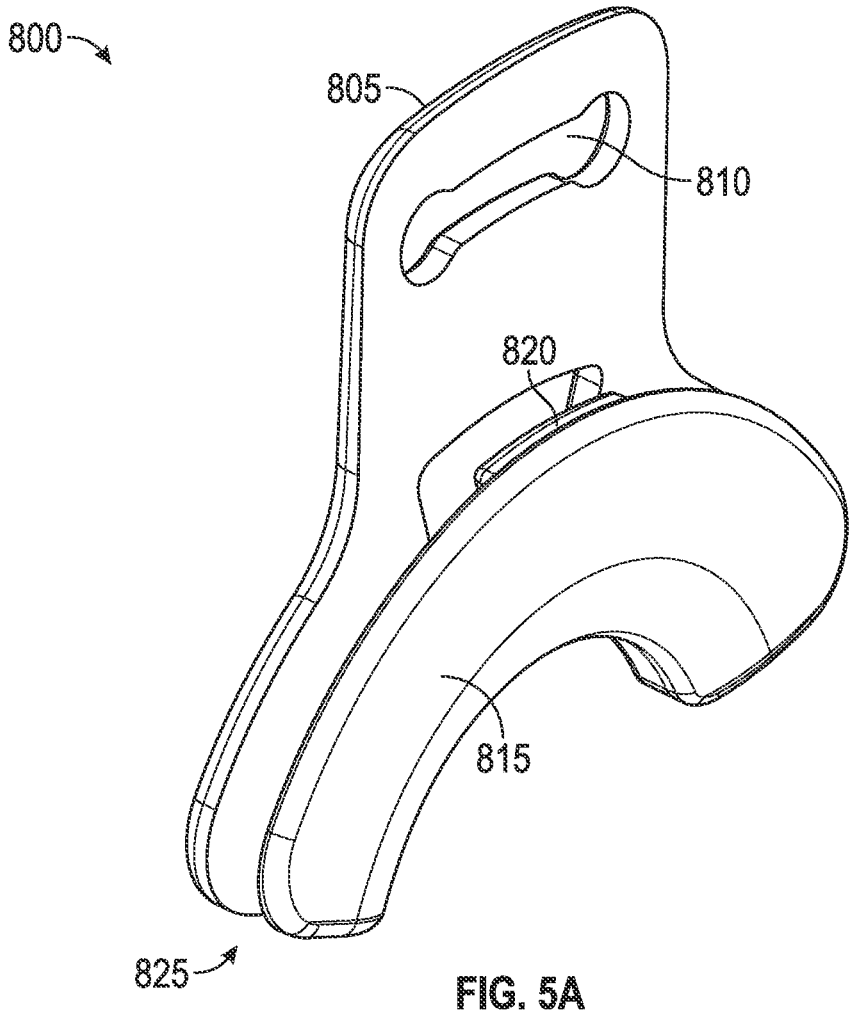
FIGS. 5A-5F are diagrams illustrating a lacing guide for use in certain lacing architectures, according to some example embodiments.
Figure 5B:
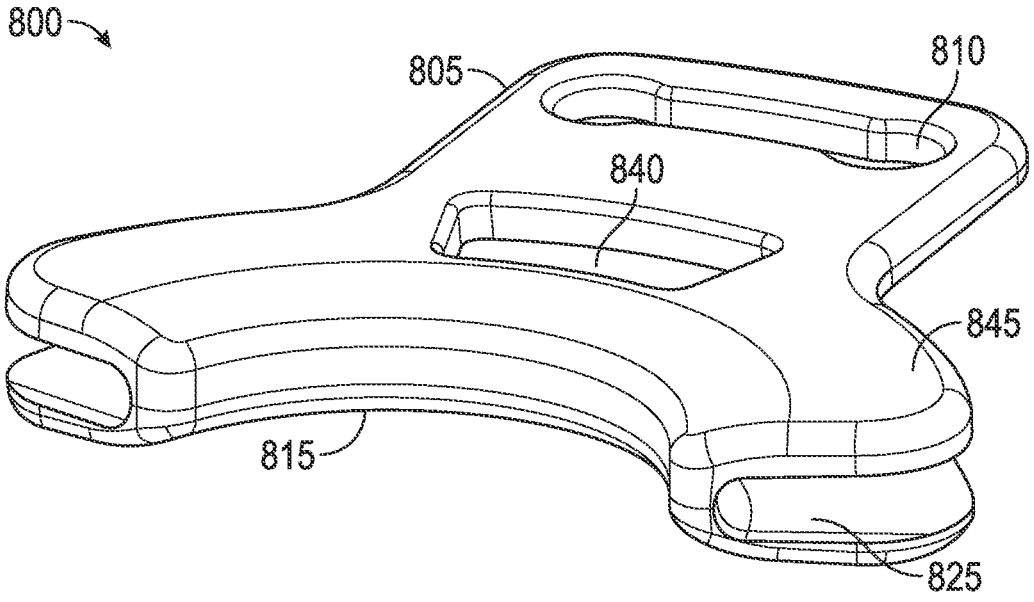
Figure 5C:
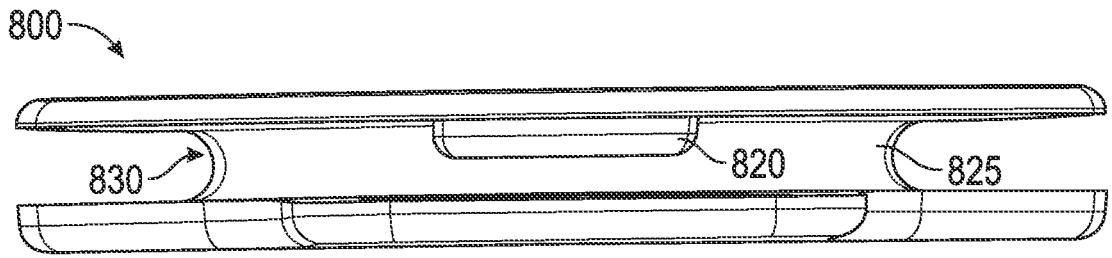
Figure 5D:
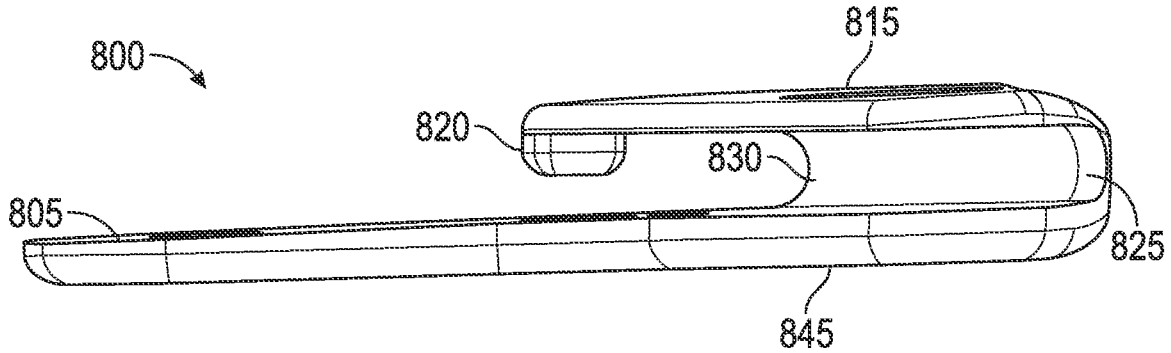
Figure 5E:
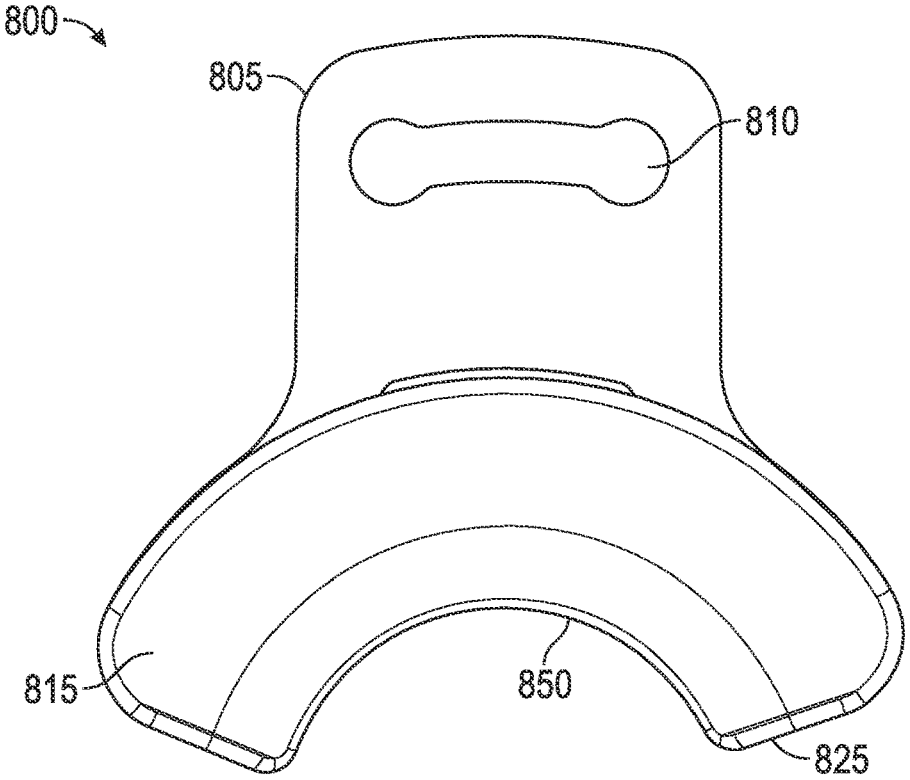
Figure 5F:
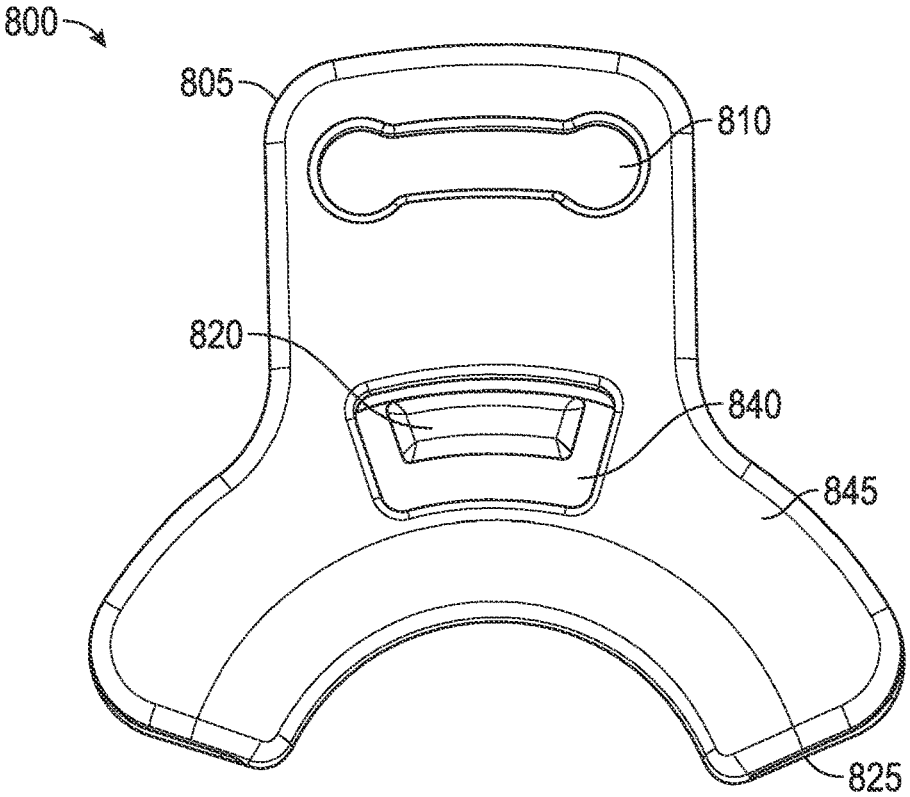

In this example, the lacing guide 800 can be initially attached to a footwear upper through stitching or adhesives. The illustrated design includes a stitch opening 810 that is configured to enable easy manual or automated stitching of lacing guide 800 onto a footwear upper (or similar material). Once lacing guide 800 is attached to the footwear upper, lace cable can be routed by simply pulling a loop of lace cable into the lace channel 825. The lace access opening 840 extends through the inferior surface 845 to provide a relief recess for the lace cable to get around the lace retainer 820. In some examples, the lace retainer 820 can be different dimensions or even be split into multiple smaller protrusions. In an example, the lace retainer 820 can be narrower in width, but extend further towards or even into access opening 840. In some examples, the access opening 840 can also be different dimensions, and will usually somewhat mirror the shape of lace retainer 820 (as illustrated in FIG. 5F). In this example, the channel radius 830 is designed to correspond to, or be slightly larger then, the diameter of the lace cable. The channel radius 830 is one of the parameters of the lacing guide 800 that can control the amount of friction experienced by the lace cable running through the lacing guide 800. Another parameter of lacing guide 800 that impacts friction experienced by the lace cable includes guide radius 850. The guide radius 850 also may impact the frequency or spacing of lace guides positioned on a footwear upper.

FIG. 5G is a diagram illustrating a portion of footwear upper 805 with a lacing architecture 890 using lacing guides 800, according to some example embodiments. In this example, multiple lacing guides 800 are arranged on a lateral side of footwear upper 805 to form half of the lacing architecture 890. Similar to lacing architectures discussed above, lacing architecture 890 uses lacing guides 800 to form a wave pattern or parachute lacing pattern to route the lace cable. One of the benefits of this type of lacing architecture is that lace tightening can produce both later-medial tightening as well as anterior-posterior tightening of the footwear upper 805.

In this example, lacing guides 800 are at least initially adhered to upper 805 through stitching 860. The stitching 860 is shown over or engaging stitch opening 810. One of the lacing guide 800 is also depicted with a reinforcement 870 covering the lacing guide. Such reinforcements can be positioned individually over each of the lacing guides 800. Alternatively, larger reinforcements could be used to cover multiple lacing guides.

Similar to the reinforcements discussed above, reinforcement 870 can be adhered through adhesives, heat-activated adhesives, and/or stitching. In some examples, reinforcement 870 can be adhered using adhesives (heat-activated or not) and a vacuum bagging process that uniformly compresses the reinforcement over the lacing guide. A similar vacuum bagging process can also be used with reinforcements and lacing guides discussed above. In other examples, mechanical presses or similar machines can be used to assist with adhering reinforcements over lacing guides.

Once all of the lacing guides 800 are initially positioned and attached to footwear upper 805, the lace cable can be routed through the lacing guides. Lace cable routing can begin with anchoring a first end of the lace cable at lateral anchor point 870. The lace cable can then be pulled into each lace channel 825 starting with the anterior most lacing guide and working posteriorly towards the heel of upper 805. Once the lace cable is routed through all lacing guides 800, reinforcements 870 can be optionally adhered over each of the lacing guides 800 to secure both the lacing guides and the lace cable.

EXAMPLES

The present inventors have recognized, among other things, a need for an improved lacing architecture for automated and semi-automated tightening of shoe laces. This document describes, among other things, example lacing architectures and example lace guides used in the lacing architectures. The following examples provide some non-limiting examples of the actuator and footwear assembly discussed herein.

Example 1 describes subject matter including a footwear assembly with a lacing architecture to facilitate automated tightening. In this example, the footwear assembly can include a footwear upper assembly, a lace cable, a plurality of lace guides, a tongue lace guide, a medial heel lace guide, a lateral heel lace guide, as well as a medial and lateral lace exit. The footwear upper assembly can include an outer layer, a floating textile layer, and a floating tongue, the footwear upper assembly including a toe box section, a medial side, a lateral side, a heel section, and a central throat section. The footwear assembly can also include a lace cable running through a plurality of lace guides. The lace cable can include a first end anchored to the upper assembly adjacent a distal medial portion of the central throat and a second end anchored to the upper assembly adjacent a distal lateral portion of the central throat. The plurality of lace guides can be distributed on the upper assembly along the medial side and the lateral side of the central throat, each lace guide of the plurality of lace guides adapted to receive a length of the lace cable. In this example, the lace cable can extend through each of the plurality of lace guides and into the tongue lace guide assembly. The tongue lace guide assembly can be secured to a proximal portion of the floating tongue, the tongue lace guide assembly adapted to receive lace cable from both the medial side and the lateral side. The medial heel guides can be positioned to receive the lace cable from the tongue lace guide along the medial side of the upper assembly. The lateral heel lace guide can be positioned to receive the lace cable from the tongue lace guide along the lateral side of the upper assembly. The medial lace exit can route the lace cable from the medial heel lace guide into a position allowing the lace cable to engage a lacing engine disposed within a mid-sole portion of the footwear assembly. The lateral lace exit can route the lace cable from the lateral heel lace guide into a position to engage the lacing engine.

In example 2, the subject matter of example 1 can optionally include the tongue lace guide assembly having a medial facing lace guide opposite a lateral facing lace guide.

In example 3, the subject matter of example 2 can optionally include the tongue lace guide assembly having an elastic member coupling the medial facing lace guide to the lateral facing lace guide.

In example 4, the subject matter of example 2 can optionally include the tongue lace guide assembly being a single structure with a rigid connection between the medial facing lace guide and the lateral facing lace guide.

In example 5, the subject matter of any one of examples 1 to 4 can optionally include the tongue lace guide assembly being fused to a reinforcement material that is stitched to the floating tongue.

In example 6, the subject matter of any one of examples 1 to 5 can optionally include the floating tongue being secured to the upper assembly adjacent to a distal end of the central throat.

In example 7, the subject matter of example 6 can optionally include the floating tongue being additionally secured to the upper assembly adjacent a proximal end of the central throat.

In example 8, the subject matter of example 7 can optionally include the floating tongue having an elastic coupling to the upper assembly.

In example 9, the subject matter of any one of examples 1 to 8 can optionally include the lace cable forming a crisscross pattern across at least a length of the central throat connecting the medial side the lateral side of the upper assembly.

In example 10, the subject matter of example 9 can optionally include the crisscross pattern being created by routing the lace cable in an alternating pattern between lace guides on the medial side and lace guides on the lateral side of the upper assembly.

In example 11, the subject matter of any one of examples 1 to 10 can optionally include the medial heel lace guide and the lateral heel lace guide being coupled, via a heel coupling, to a heel counter within the heel section of the upper assembly.

In example 12, the subject matter of example 11 can optionally include at least one of the heel counter or the heel coupling being an elastic member.

In example 13, the subject matter of any one of examples 1 to 12 can optionally include each lace guide of the plurality of lace guides forming a u-shaped channel to retain the lace cable.

In example 14, the subject matter of example 13 can optionally include the u-shaped channel in each lace guide being an open channel allowing a lace loop to be pulled into the lace guide.

In example 15, the subject matter of any one of examples 1 to 14 can optionally include each lace guide of the plurality of lace guides being at least secured to the upper assembly by stitching.

In example 16, the subject matter of example 15 can optionally include each lace guide of the plurality of lace guides being further secured to the upper assembly with an overlay including heat-activated adhesive compressed over each lace guide.

Example 17 describes subject matter including a lacing architecture for an automated footwear platform. In this example, the lacing architecture for an automated footwear platform can include a lace cable routed through a plurality of medial lace guides and a plurality of lateral guides into a tongue lace guide. For the tongue lace guide the lace cable can be routed into a medial heel lace guide and/or a lateral heel lace guide, which then leads to either a medial lace exit or a lateral lace exit. The lace cable can include a first end anchored to an upper assembly adjacent a distal medial portion of a central throat and a second end anchored to the upper assembly adjacent a distal lateral portion of the central throat. The plurality of medial lace guides can be distributed on the upper assembly adjacent to a medial side of the central throat. The tongue lace guide can be secured to a proximal portion of a floating tongue, with the tongue lace guide assembly adapted to receive lace cable from a medial lace guide of the plurality of medial lace guides and a lateral lace guide of the plurality of lateral lace guides. The medial heel lace guide can be positioned to receive the lace cable from the tongue lace guide along a medial side of the upper assembly. While, the lateral heel lace guide can be positioned to receive the lace cable from the tongue lace guide along a lateral side of the upper assembly. The medial lace exit can route the lace cable from the medial heel lace guide into a position allowing the lace cable to engage a lacing engine disposed within a mid-sole portion of the footwear platform. While the lateral lace exit routes the lace cable from the lateral heel lace guide into a position to engage the lacing engine.

In example 18, the subject matter of example 17 can optionally include the tongue lace guide having a medial facing lace guide opposite a lateral facing lace guide.

In example 19, the subject matter of example 18 can optionally include the tongue lace guide including an elastic member coupling the medial facing lace guide to the lateral facing lace guide.

In example 20, the subject matter of example 18 can optionally include the tongue lace guide assembly being a single structure with a rigid connection between the medial facing lace guide and the lateral facing lace guide.

In example 21, the subject matter of example 17 can optionally include the tongue lace guide being fused to a reinforcement material that is stitched to a floating tongue.

Example 22 describes subject matter including a footwear assembly with a lacing architecture to facilitate automated tightening. In this example, the footwear assembly can include a footwear upper assembly, a lace cable, a plurality of lace guides, a tongue lace guide, a medial heel lace guide, a lateral heel lace guide, as well as a medial and lateral lace exit. The lace cable can include a first end anchored to the upper assembly in a first anchor location and a second end anchored to the upper assembly in a second anchor location. A first plurality of lace guides can form a first lacing zone routing a first portion of the lace cable to tension a forefoot region of the footwear assembly. A second plurality of lace guides can form a second lacing zone routing a second portion of the lace cable to tension a mid-foot region of the footwear assembly. A tongue lace guide assembly can be secured to a proximal portion of the floating tongue, the tongue lace guide assembly adapted to receive lace cable from both the medial side and the lateral side. The medial heel lace guide can be positioned to receive the lace cable from the tongue lace guide along the medial side of the upper assembly. The lateral heel lace guide can be positioned to receive the lace cable from the tongue lace guide along the lateral side of the upper assembly. The medial lace exit can route the lace cable from the medial heel lace guide into a position allowing the lace cable to engage a lacing engine disposed within a mid-sole portion of the footwear assembly. The lateral lace exit can route the lace cable from the lateral heel lace guide into a position to engage the lacing engine.

In Example 23, the subject matter of Example 22 can optionally include the second plurality of lace guides having a greater number of lace guides than the first plurality of lace guides.

In Example 24, the subject matter of any one of Examples 22 and 23 can optionally include the second plurality of lace guides distributing lace cable tension across a larger area of the footwear assembly than the first plurality of lace guides.

In Example 25, the subject matter of any one of Examples 1 to 3 can optionally include the first plurality of lace guides including a medial lace guide on the medial side of the central throat section and two lateral lace guides on the lateral side of the central throat section.

In Example 26, the subject matter of Example 25 can optionally include the first lateral lace guide of the two lateral lace guides being located towards a distal end of the central throat section and the second lateral lace guide of the two lateral lace guides being located towards a proximal end of the central throat section.

In Example 27, the subject matter of Example 26 can optionally include the lace cable path for the first lacing zone including the path segments such as: the first anchor location to the medial lace guide; the medial lace guide to the first lateral lace guide; and the first lateral lace guide to the second lateral lace guide.

In Example 28, the subject matter of Example 27 can optionally include the lace cable path for the first lacing zone continuing from the first second lateral lace guide to a lateral facing lace guide in the tongue lace guide assembly.

In Example 29, the subject matter of Example 28 can optionally include the lace cable path for the first lacing zone continuing from the lateral facing lace guide to the lateral heel lace guide.

In Example 30, the subject matter of any one of Examples 22 to 29 can optionally include the second plurality of lace guides forming the second lacing zone including a first lateral lace guide disposed along a central portion of a lateral side of the central throat section and a plurality of medial lace guides distributed along a length of a medial side of the central throat section.

In Example 31, the subject matter of Example 30 can optionally include the lace cable path for the second lacing zone including the path segments such as: the second anchor location to a first medial lace guide of the plurality of medial lace guides; the first medial lace guide to the first lateral lace guide; the first lateral lace guide to a second medial lace guide of the plurality of medial lace guides.

In Example 32, the subject matter of Example 31 can optionally include the second anchor location is located on a lateral side of the central throat section proximal at least one lace guide from the first lacing zone.

In Example 33, the subject matter of any one of Example 30 and 31 can optionally include the lace cable path for the second lacing zone further including a path segment running from the second medial lace guide to a medial facing lace guide within the tongue lace guide assembly.

In Example 34, the subject matter of Example 33 can optionally include the lace cable path for the second lacing zone continuing from the lateral facing lace guide to the lateral heel lace guide.

In Example 35, the subject matter of any one of Examples 22 to 34 can optionally include the first anchor location being on the lateral side distal of the central throat section, and the second anchor location being on the lateral side adjacent to a first lateral lace guide.

In Example 36, the subject matter of any one of Examples 22 to 35 can optionally include the tongue lace guide assembly having a medial facing lace guide opposite a lateral facing lace guide.

In Example 37, the subject matter of Example 36 can optionally include the tongue lace guide assembly having an elastic member coupling the medial facing lace guide to the lateral facing lace guide.

In Example 38, the subject matter of Example 36 can optionally include the tongue lace guide assembly is a single structure with a rigid connection between the medial facing lace guide and the lateral facing lace guide.

In Example 39, the subject matter of Example 38 can optionally include the tongue lace guide assembly being fused to a reinforcement material that is stitched to the floating tongue.

In Example 40, the subject matter of any one of Examples 22 to 39 can optionally include the medial heel lace guide and the lateral heel lace guide being coupled, via a heel coupling, to a heel counter within the heel section of the upper assembly.

In Example 41, the subject matter of Example 40 can optionally include at least one of the heel counter or the heel coupling being an elastic member.

Example 42 describes subject matter including a lacing architecture for an automated footwear platform. In this example, the lacing architecture can include a lace cable, a first lacing zone and a second lacing zone. The lace cable can include a first end anchored to an upper footwear assembly adjacent a distal lateral portion of a central throat and a second end anchored to the upper assembly adjacent a first lateral lace guide on a lateral portion of the central throat. The first lacing zone can include a first portion of the lace cable running from the first end over the central throat to a first medial lace guide back over the central throat to a first lateral lace guide proximal along a lateral side of the central throat to a third lateral lace guide proximal to a lateral facing lace guide within a tongue lace guide assembly laterally to a lateral heel lace guide and on to a lateral lace exit along a lateral edge of the footwear upper. The second lacing zone can include a second portion of the lace cable running from the second end over the central throat to a second medial lace guide back over the central throat to a second lateral lace guide back over the central throat to a third medial lace guide proximally to a medial facing lace guide within the tongue lace guide assembly medially to a medial heel lace guide and on to a medial lace exit along a medial edge of the footwear upper.

ADDITIONAL NOTES

Throughout this specification, plural instances may implement components, operations, or structures described as a single instance. Although individual operations of one or more methods are illustrated and described as separate operations, one or more of the individual operations may be performed concurrently, and nothing requires that the operations be performed in the order illustrated. Structures and functionality presented as separate components in example configurations may be implemented as a combined structure or component. Similarly, structures and functionality presented as a single component may be implemented as separate components. These and other variations, modifications, additions, and improvements fall within the scope of the subject matter herein.

Although an overview of the inventive subject matter has been described with reference to specific example embodiments, various modifications and changes may be made to these embodiments without departing from the broader scope of embodiments of the present disclosure. Such embodiments of the inventive subject matter may be referred to herein, individually or collectively, by the term "invention" merely for convenience and without intending to voluntarily limit the scope of this application to any single disclosure or inventive concept if more than one is, in fact, disclosed.

The embodiments illustrated herein are described in sufficient detail to enable those skilled in the art to practice the teachings disclosed. Other embodiments may be used and derived therefrom, such that structural and logical substitutions and changes may be made without departing from the scope of this disclosure. The disclosure, therefore, is not to be taken in a limiting sense, and the scope of various embodiments includes the full range of equivalents to which the disclosed subject matter is entitled.

As used herein, the term "or" may be construed in either an inclusive or exclusive sense. Moreover, plural instances may be provided for resources, operations, or structures described herein as a single instance. Additionally, boundaries between various resources, operations, modules, engines, and data stores are somewhat arbitrary, and particular operations are illustrated in a context of specific illustrative configurations. Other allocations of functionality are envisioned and may fall within a scope of various embodiments of the present disclosure. In general, structures and functionality presented as separate resources in the example configurations may be implemented as a combined structure or resource. Similarly, structures and functionality presented as a single resource may be implemented as separate resources. These and other variations, modifications, additions, and improvements fall within a scope of embodiments of the present disclosure as represented by the appended claims. The specification and drawings are, accordingly, to be regarded in an illustrative rather than a restrictive sense.

Each of these non-limiting examples can stand on its own, or can be combined in various permutations or combinations with one or more of the other examples.

The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In the event of inconsistent usages between this document and any documents so incorporated by reference, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

The above description is intended to be illustrative, and not restrictive. For example, the above-described examples (or one or more aspects thereof) may be used in combination with each other. Other embodiments can be used, such as by one of ordinary skill in the art upon reviewing the above description. An Abstract, if provided, is included to comply with 37 C.F.R. § 1.72(b), to allow the reader to quickly ascertain the nature of the technical disclosure. It is submitted with the understanding that it will not be used to interpret or limit the scope or meaning of the claims. Also, in the above Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description as examples or embodiments, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

The claimed invention includes:

1. An apparatus comprising a floating tongue configured to be disposed within a footwear assembly; and a tongue lace guide assembly secured to a proximal portion of the floating tongue, the tongue lace guide assembly including a single structure with a rigid connection between two spaced apart opposing lace guides, the two spaced apart opposing lace guides including a first medial facing U-shaped lace guide channel adapted to receive a medial portion of a lace cable from a medial side of the footwear assembly and route the medial portion back along the medial side and a second lateral facing U-shaped lace guide channel adapted to receive a lateral portion of the lace cable from a lateral side of the footwear assembly and route the lateral portion back along the lateral side, wherein the first medial facing U-shaped lace guide channel and the second lateral facing U-shaped lace guide channel include open lace channels.

2. The apparatus of claim 1, wherein the tongue lace guide assembly is adhered fused to a reinforcement material that is affixed to the floating tongue.

3. The apparatus of claim 1, wherein the tongue lace guide assembly is coupled to a tongue lace guide reinforcement.

4. The apparatus of claim 3, wherein the tongue lace guide reinforcement is coupled to the floating tongue by one or more of an adhesive and stitching.

5. The apparatus of claim 3, wherein the tongue lace guide reinforcement is adapted to distribute forces applied on the tongue lace guide assembly.

6. A footwear assembly including:

a lace cable routed through lace guides on a footwear upper;

a floating tongue disposed within a throat portion of the footwear upper; and a tongue lace guide assembly secured to a proximal portion of the floating tongue, the tongue lace guide assembly including a single structure with a rigid connection between two discrete, spaced apart, and opposing lace guides affixed to the single structure, the opposing lace guides include a first medial facing U-shaped lace guide channel adapted to receive a medial portion of the lace cable from a medial side of the footwear upper and route the medial portion back along the medial side of the footwear upper and a second lateral facing U-shaped lace guide channel adapted to receive a lateral portion of the lace cable from a lateral side of the footwear upper and route the lateral portion back along the lateral side of the footwear upper, wherein the first medial facing U-shaped lace guide channel and the second lateral facing U-shaped lace guide channel include open channels configured to receive a portion of the lace cable.

7. The footwear assembly of claim 6, wherein the tongue lace guide assembly is adhered to a reinforcement material that is affixed to the floating tongue.

8. The footwear assembly of claim 6, wherein the tongue lace guide assembly is coupled to a tongue lace guide reinforcement.

9. The footwear assembly of claim 8, wherein the tongue lace guide reinforcement is coupled to the floating tongue by one or more of an adhesive and stitching.

10. The footwear assembly of claim 8, wherein the tongue lace guide reinforcement is adapted to distribute forces applied on the tongue lace guide assembly.

* * * * *